United States Patent [19]

Lee

[11] Patent Number: 4,462,244

[45] Date of Patent: Jul. 31, 1984

[54] APPARATUS FOR FIELD TESTING A SMOKE DETECTOR

[76] Inventor: Thomas G. Lee, 1122B Aster Ave., Sunnyvale, Calif. 94086

[21] Appl. No.: 373,910

[22] Filed: May 3, 1982

[51] Int. Cl.³ ..... G08B 29/00

[52] U.S. Cl. ..... 73/1 G

[58] Field of Search ..... 73/1 G; 222/4; 137/892, 137/888

[56] References Cited

U.S. PATENT DOCUMENTS 2,816,441 12/1957 Ezekiel ..... 73/861.58

3,693,401 9/1972 Purt ..... 73/1 G

FOREIGN PATENT DOCUMENTS 1113069 3/1956 France ..... 137/888

54-11563 1/1979 Japan ..... 137/888

*Primary Examiner*—Charles Frankfort

*Assistant Examiner*—Denis E. Corr

*Attorney, Agent, or Firm*—Fliesler, Dubb, Meyer & Lovejoy

[57] ABSTRACT

An apparatus (10,10') for in situ testing of a smoke detector (12,12') is set forth. A structure (14,14') has either first (28) and second (30) openings (28,30) or a single opening (28') to an interior chamber (22,22'). Air is impelled through the first opening (28) or the single opening (28') into the chamber (22,22') where it is thoroughly mixed with aerosol particles from a spray can (56,56'). The air-aerosol mixture exits the chamber (22,22') via the second opening (30) or the single opening (28') and travels via a wand structure (38,38') to the vicinity of the smoke detector (12,12').

2 Claims, 3 Drawing Figures

APPARATUS FOR FIELD TESTING A SMOKE DETECTOR

Technical Field

The present invention is directed to an apparatus for field testing smoke detectors, more particularly, the type of installed smoke detectors which are utilized in homes, hotels, and commercial establishments and are often mounted against the ceiling or wall.

Background Art

How quickly a smoke detector will sound off an alarm in case of a fire depends on the threshold setting of the detector. Most detectors are factory adjusted to an alarm threshold of between 1% and 2% smoke obscuration per foot (equivalent to mass concentrations of about 10 milligrams per cubic meter and 20 milligrams per cubic meter, respectively). However, after installation the threshold levels may drift considerably depending on environmental conditions, for example, dust, grease, and moisture to which the smoke detector is exposed. Also, aging can effect the threshold level. Smoke detector failure does occur and is a potential threat to safety. To assure maximum protection, periodic testing of installed detectors is important.

Prior art smoke detector testing apparatus for in field use has generally consisted of an aerosol generator which produces a stable aerosol with a particle size distribution resembling the smoke currently used in the standard laboratory detector sensitivity test (UL-268 test standard of Underwriter Laboratories, Inc.). When a smoke detector, is exposed to a test stream with aerosol concentration equal to or above the set threshold of the detector it will sound an alarm. To find the alarm threshold, the prior art apparatus has included means for stepwise increasing the aerosol concentration in the test stream. The prior art aerosol generators have generally consisted of a pneumatic nebulizer powered by an electric compressor to produce an aerosol from dioctylphthalate liquid. An impactor is used to select the particles with the proper size distribution after they exit the nebulizer. These particles are then mixed with and diluted with air from a blower to produce the needed concentrations. The prior art aerosol generators have generally used a pump to serve as a compressor and also to provide a vacuum for evacuating a reservoir to which the sized particles from the impactor are returned. The apparatus is relatively costly due to the expense of the pump, the nebulizer, flowmeter and the impactor. Further, it has been relatively heavy and noisy.

A simpler prior art device is disclosed in U.S. Pat. No. 3,693,401 of Purt, et al, issued Sept. 26, 1972. In that device an aerosol can serves to spray an aerosol of high concentration with unknown particle sizes directly about a smoke detector. Such device does not, however, provide a series of levels of aerosol whereby the sensitivity of the detector can be quantized. Also, since the aerosol is sprayed directly at the housing of the smoke detector large local concentration gradients of aerosol may occur, whereby, a detector which has unacceptably low sensitivity may falsely test out as having adequate sensitivity.

Disclosure of the Invention

The present invention is directed to solving one or more of the problems as set forth above.

In accordance with an embodiment of the present invention, an apparatus is provided for field testing a smoke detector without removing it from the installed location. The apparatus comprises a structure having a lateral wall portion, a top portion and a bottom portion which together define an interior chamber having first and second locations. The structure has first and second openings communicating the interior chamber to an exterior of the structure. Air impelling means, e.g., a fan serves for impelling air from the exterior of the structure, through the first opening, and along a flow path through the first location in the chamber and towards the second location in the chamber. Movable wand means serves for directing air from the second location in the chamber, through the second opening, and into the immediate vicinity of the smoke detector. The second location in the chamber is located out of the direct flow path of air impelled by the air impelling means. A pressurized spray can contains a mixture of liquified propellant along with a non-volatile liquid as a smoke simulator. On top of the can is a valve actuator which is actuatable from the exterior of the structure. The valve is designed to deliver a specific volume of the mixture for each actuation of the actuator. The valve and nozzle deliver a spray of aerosol particles of the smoke simulator to the first location in the chamber on vaporization of the propellant. The mean particle size and size distribution of the smoke aerosol from the spray closely resemble the smoke used in the standard laboratory tests for detector sensitivity. As a result, sensitivity ranking of detectors based on the present field tests is substantially identical to those based on standard laboratory use.

In accordance with another embodiment of the invention a smoke detector testing apparatus comprises a collapsible bag structure defining an interior cavity. Air impelling means can be used to impel air through an opening into the interior chamber or out through the opening via wand means to adjacent the smoke detector. A pressurized spray can is actuable to spray aerosol particles of a smoke simulator into the interior chamber. Switch means control the direction of impelling of air by the air impelling means.

An apparatus as set out above has the advantages of being quiet in operation, inexpensive, and easy to operate in the field. Yet, such an apparatus allows for testing the threshold level of a smoke detector with essentially equal accuracy to the prior art aerosol generator type of smoke detector tester.

Detailed Description of the Preferred Embodiment

Figure 2:
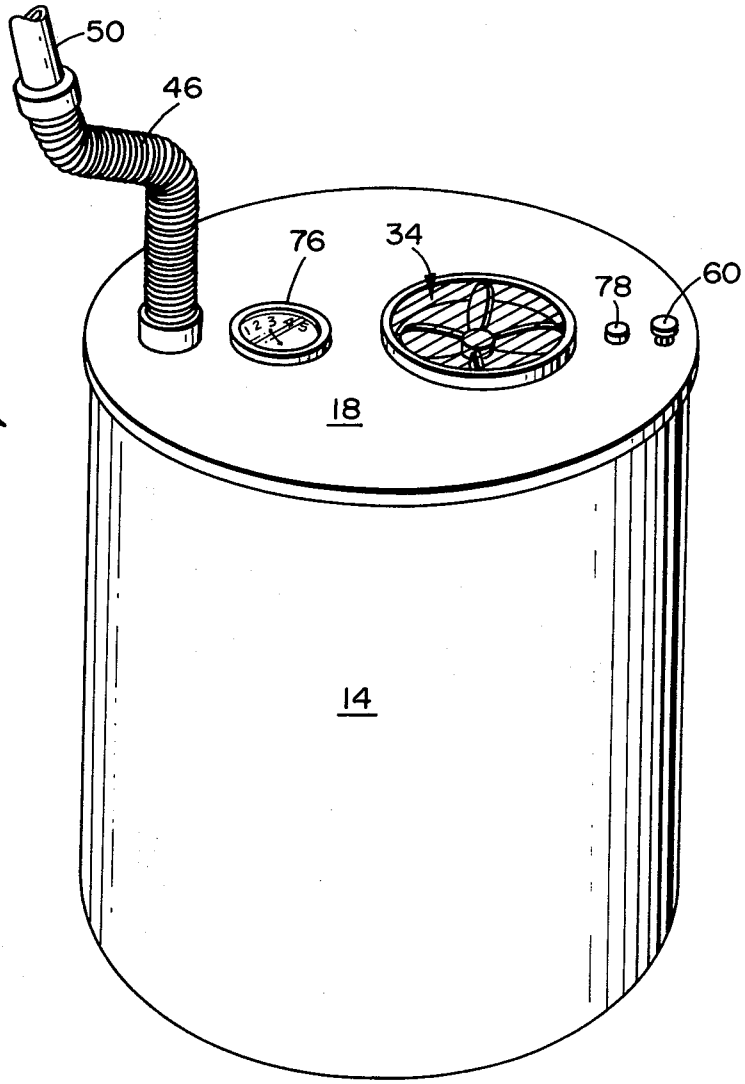
FIG. 2 illustrates, in perspective, the apparatus of FIG. 1.
Figure 1:
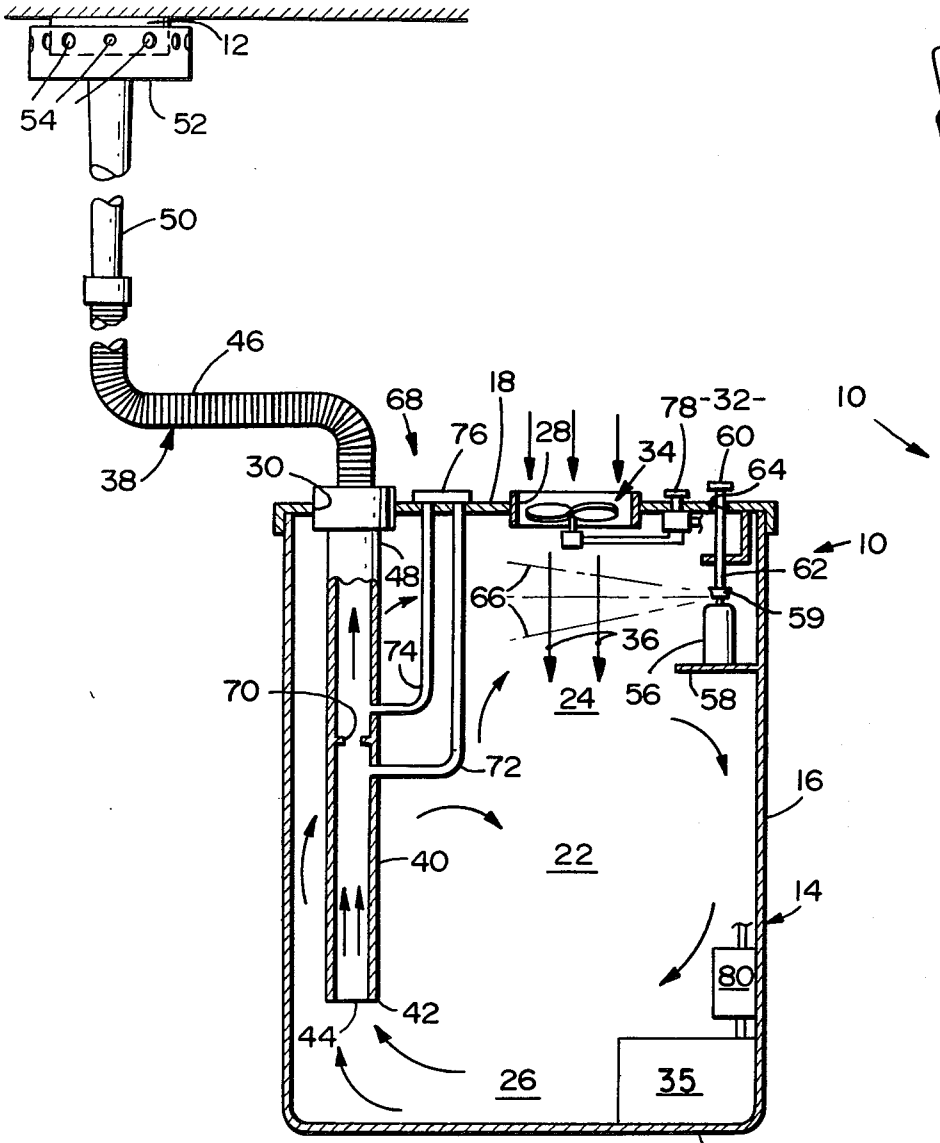
FIG. 1 illustrates, in side section, an apparatus in accordance with the present invention.

An apparatus 10 for testing a smoke detector 12 is illustrated in FIGS. 1 and 2. The apparatus 10 includes a structure 14, in the embodiment illustrated a small barrel about 0.4 meter in height. The structure 14 has a lateral wall portion 16, in the embodiment illustrated the side wall of the barrel, a top portion 18, in the embodiment illustrated the cover of the barrel, and a bottom portion 20, in the embodiment illustrated the bottom of the barrel.

Adverting to FIG. 2, the lateral wall portion 16, the top portion 18, and the bottom portion 20 together define an interior chamber 22 having a first location 24 and a second location 26. The structure 14 has a first opening 28 and a second opening 30. In the embodiment illustrated the first opening 28 and the second opening 30 are both through the top portion 18 of the structure 14. The openings 28 and 30 communicate the interior chamber 22 with an exterior space 32 surrounding the structure 14.

Air impelling means 34 is provided, in the embodiment illustrated a conventional motor drive fan powered by a rechargeable battery 35. The air impelling means 34 serves for impelling air from the exterior space 32 about the structure 14 through the first opening 28 and along a flow path as indicated by arrows 36 through the first location 24 in the chamber 22 and towards the second location 26 in the chamber 22.

Movable wand means 38 serve for directing air from the second location 26 in the chamber 22 through the second opening 30 and into the immediate vicinity of the smoke detector 12. The second location 26 is located out of the direct flow path 36 of air impelled by the air impelling means 34. The wand means 38 includes a tubular member 40 having a lower end 42 and extending from the second opening 30 to the second location 26 in the chamber 22. In the embodiment illustrated the second location 26 is located below the first location 24. The tubular member 40 is generally flow impervious along its length and has an air flow accepting orifice 44 at its lower end 42. The movable wand means 38 generally includes a flexible hose member 46 which is connected to an upper end 48 of the tubular member 40. The flex hose 46 is also connected to a wand 50 which is generally rigid and includes a shroud 52 adapted to fit up and around the smoke detector 12. Holes 54 in the shroud 52 allow test aerosol to flow upwardly through the movable wand means 38 and exit at the vicinity of the smoke detector 12 to flush the system.

A pressurized spray can 56 located in the chamber 22 can be mounted on a shelf 58 which is itself attached to the lateral wall portion 16 of the structure 14. The pressurized spray can 56 would contain a mixture of a propellant, for example trichlorofluoromethane, dichlorodifluoromethane, or a mixture thereof. The mixture within the spray can would also include a smoke simulator, generally a non-volatile liquid, for example, mineral oil or dioctylphthalate.

The mean particle size and size distribution of the generated aerosol smoke from the can is designed to match the standardized smoke used in the laboratory tests. To do this, the concentration of the non-volatile liquid in the propellant charge is generally fixed at about 1% by weight, the selected propellant generally provides a pressure of 68 pound per square inch gauge in the can at room temperature, and the diameter of the valve nozzle 82 is preferably 0.33 milimeter.

The pressurized spray can 56 is of a conventional nature such as is shown, for example, in U.S. Pat. No. 2,968,427. Such a pressurized spray can 56 includes a nozzle 59, an interior valve and a valve actuator 60 which is actuatable from the exterior space 32 about the structure 14. In the particular embodiment illustrated, the actuator 60 includes a rod member 62 which extends through a third opening 64 in the structure 14, and more particularly in the top portion 18 of the structure 14. The valve is of the nature described in the above referenced patent and is adapted to deliver a specific volume of the mixture contained within the spray can 56 for each actuation of the actuator 60. If differing levels of smoke simulator are desired, the actuator is simply depressed a different number of times. Thus, for example, if 1% of smoke obscuration per foot is desired, the actuator 60 would be depressed one time, if 2% smoke obscuration per foot was desired, the actuator would be quickly depressed two times, etc.

The pressurized spray can 56 delivers a spray 66 of aerosol particles of the smoke simulator to the first location 24 in the chamber 22 on vaporization of the propellant. The spray 66 of aerosol particles is preferably directed generally into the flow path 36 to be mixed and diluted with the air impelled by the air impelling means 34 to provide a very uniform aerosol. And, the flow path 36 is selected to sweep the diluted spray of aerosol particles into the second location 26 in the chamber 22, through the air flow accepting orifice 44 and eventually through the shroud 52 of the wand 50 and about the smoke detector 12.

Means 68 are provided for measuring the velocity of air flow through the wand means 38. In the embodiment illustrated the velocity measuring means 68 includes a restricted orifice 70 in the tubular member 40, a conduit 72 connected upstream of the restricted orifice 70 and a conduit 74 connected downstream of the restricted orifice 70, the conduit 72 and 74 being connected to a conventional flow rate monitor such as the Magnehelic gauge 76.

Means 78 are provided for adjusting the velocity of air impelled by the air impelling means 34. In the embodiment illustrated, such means 78 simply comprises a conventional rheostat and switch which serves to turn on the fan and to adjust its speed. The air velocity used in the test also corresponds to that used in the standard laboratory test.

In accordance with the present invention it is desirable to provide time delay means 80, in the embodiment illustrated a time delay relay, for terminating operation of the air impelling means 34 a selected period of time after initiating of operation thereof. The time delay means 80 provides for a standardized time of flow of smoke simulator containing air past the smoke detector 12, thus further standardizing the testing. Also, some types of smoke detectors 12 have a significant time delay before they will respond. Generally, such time delay is of the order of 8 to 10 seconds. Hence, the time delay relay 80 would normally be set for about 12 to 15 seconds.

Alternate Embodiment

Figure 3:
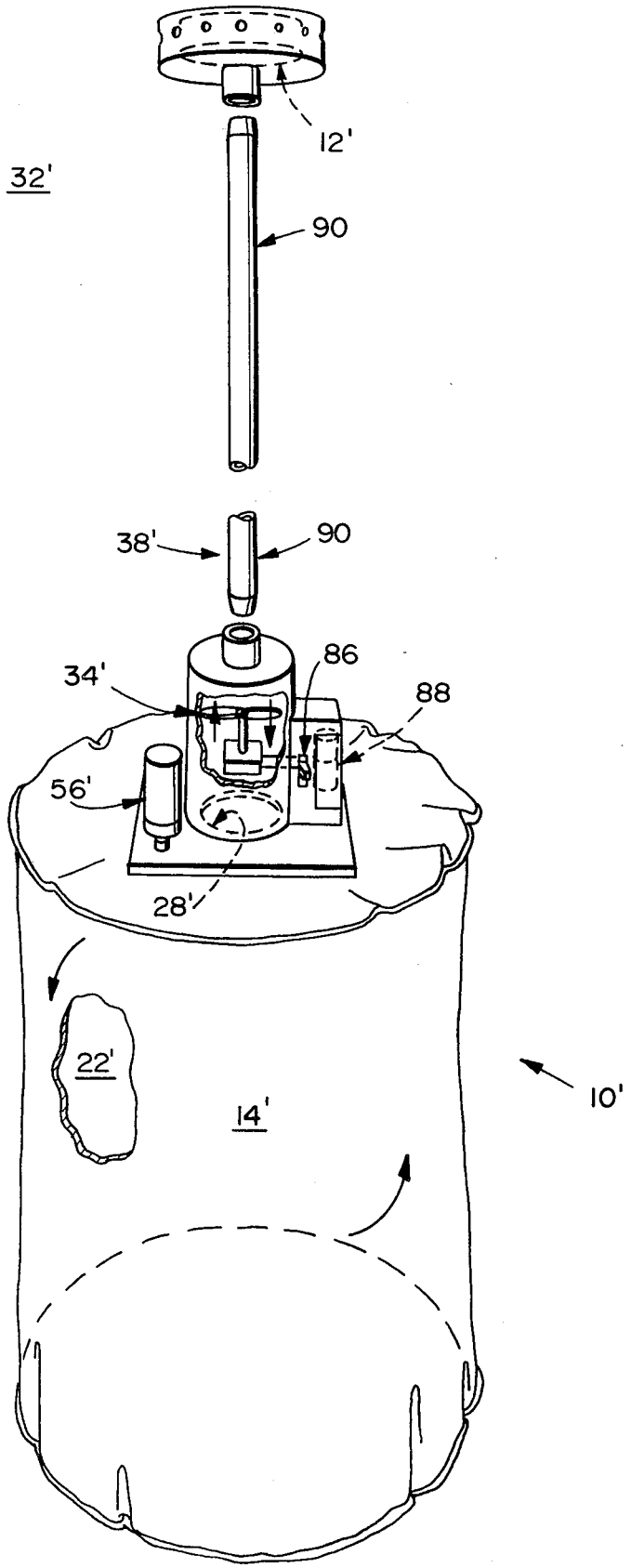
FIG. 3 illustrates, in side view, partially broken away, an alternate apparatus in accordance with the present invention.

FIG. 3 illustrates an alternate embodiment of the present invention which utilizes a collapsible bag structure 14' in place of the structure 14 of the embodiment of FIGS. 1 and 2. In the embodiment of FIG. 3, air impelling means 34' are positioned for directing air from a single opening 28' to an interior chamber 22' of the bag structure 14'. The air impelling means 34' is reversible in nature and can also be used for impelling air from the interior chamber 22' through movable wand means 38' into the immediate vicinity of a smoke detector 12'. A pressurized spray can 56' extends into the interior chamber 22' and serves the same purpose as does the pressurized spray can 56 of the embodiment of FIGS. 1 and 2. The direction of the air impelled by the air impelling means 34' is determined by the setting of a conventional three-way switch 86. Power for the fan is supplied by a small rechargable battery 88.

Industrial Applicability

An apparatus 10 as set forth in FIGS. 1 and 2 of the present specification is useful in testing smoke detectors 12 to determine the actual threshold setting of the detectors 12. In operation, the user simply positions the shroud 52 of the wand 50 about a smoke detector 12. The air impeller 34 is started and its speed adjusted and a single spray 66 of aerosol particles is injected into the flow path 36 by pushing upon the rod member 62. The operator simply listens for the alarm of the smoke detector 12. If the alarm does not go off, the operator repeats the operation, but using two actuations of the rod member 62. If the alarm in the smoke detector 12 still does not go off, the operation can be repeated again using 3, 4, or more actuations of the rod member 62. In this manner, the approximate quantitative sensitivity of the smoke detector 12 can be rapidly determined. All mixing of aerosol with air occurs in the relatively large chamber 22 in a manner whereby the aerosol concentration which reaches the detector 12 is very uniform during the test period of 12 to 15 seconds. This serves to assure uniformity in testing.

The apparatus 10' as set forth in FIG. 3 operates as follows. The bag structure 14' is inflated by the operation of the air impelling means 34'. While the bag is being inflated, aerosol from the pressurized spray can 56' is injected into the bag structure 14'. Generally, the pressurized spray can 56' is used to introduce aerosol into the bag structure 14' when the bag structure 14' is inflated about 80% of its capacity. The air impelling means 34', in filling the bag structure 14' the rest of the way, serves to very uniformly mix the air in the bag with the aerosol. Generally, the air impelling means 34' is kept in operation impelling air in the direction of the interior chamber 22' of the bag structure 14' while the movable wand means 38' is positioned to deliver the aerosol-air mixture to the smoke detector 12'. The switch 86' is then thrown to reverse the direction of air being impelled by the air impelling means 34'. The contents of the bag structure 14' then move through the wand means 38' to the area of the smoke detector 12'. The bag structure 14' gradually collapses during this operation. If the bag is approximately 25 liters in diameter and the speed of the air impelling means 34' is properly chosen, the total discharge time from the bag structure 14' is about 15 seconds. This is sufficient time to trigger the alarm in the smoke detector 12' if the aerosol concentration is above the triggering threshold of the smoke detector 12'. As with the embodiment of FIGS. 1 and 2, the concentration of aerosol can be doubled, tripled, etc., by successively activating the pressurized spray can 56', which is of the same nature as the pressurized spray can 56 in the embodiment of FIGS. 1 and 2. The wand means 38' can be made of adjustable length by utilizing intermediates sections 90 of any desired length, for example up to 25 feet or even more. The aerosol is thoroughly mixed with the air in the bag structure 14' to provide a very uniform mixture for testing purposes.

Other aspects, objects and advantages of this invention can be obtained from a study of the drawings, the disclosure and the appended claims.

I claim:

1. An apparatus (10') for field testing of an installed smoke detector (12'), comprising:

a collapsible bag structure (14') defining an interior chamber (22'), said collapsible bag structure (14') having an opening (28') communicating said interior chamber (2') to a space (32') exterior of said collapsible bag structure (14');

air impelling means (34') for selectively impelling air via the opening (28') between the space (32') and the interior chamber (22');

movable wand means (38') for directing air from said interior chamber (22') through said opening (28') and into the immediate vicinity of said smoke detector (12');

a pressurized spray can (56') containing a mixture of a propellant and a smoke simulator and being actuable from exterior of said collapsible bag structure (14'), said spray can (56') being adapted to deliver a specific volume of said mixture for each actuation thereof and to deliver a spray of aerosol particles of said smoke simulator to said interior chamber (22') on vaporization of said propellant; and switch means (86) for selectively controlling said air impelling means (34) for impelling air from the space (32') through said opening (28') and into said interior chamber (22') or from said interior chamber (22') through said opening (28'), and through said movable wand means (38') to the immediate vicinity of said smoke detector (12').

2. An apparatus (10') as set forth in claim 1, wherein said movable wand means (38') includes an intermediate section (90) for adjusting the length thereof.

* * * * *

UNITED STATES PATENT AND TRADEMARK OFFICE

CERTIFICATE OF CORRECTION

PATENT NO. : 4,462,244

DATED : July 31, 1984

INVENTOR(S) : Thomas G. Lee

It is certified that error appears in the above-identified patent and that said Letters Patent is hereby corrected as shown below:

Column 6, line 24, after "chamber", (2') should be (22').

Signed and Sealed this

*Fifteenth* Day of *January 1985*

[SEAL]

*Attest:*

GERALD J. MOSSINGHOFF

*Attesting Officer*

*Commissioner of Patents and Trademarks*